US008900011B2

(12) United States Patent
Pichot et al.

(10) Patent No.: US 8,900,011 B2
(45) Date of Patent: Dec. 2, 2014

(54) ELECTRICAL CONNECTOR WITH FLAME-RESISTANT INSERTS

(71) Applicant: Souriau, Versailles Cedex (FR)

(72) Inventors: Thomas Pichot, Le Mans (FR); Daniel Gloaguen, Le Mans (FR)

(73) Assignee: Souriau, Versailles Cedex (FR)

( * ) Notice: Subject to any disclaimer, the term of this patent is extended or adjusted under 35 U.S.C. 154(b) by 7 days.

(21) Appl. No.: 13/625,071

(22) Filed: Sep. 24, 2012

(65) Prior Publication Data

US 2014/0087575 A1 Mar. 27, 2014

(51) Int. Cl.
*H01R 13/40* (2006.01)

(52) U.S. Cl.
USPC ..... 439/589; 439/935

(58) Field of Classification Search
CPC .. H01R 13/52; H01R 13/521; H01R 13/5219; H01R 13/533; H01R 13/5205; H01R 13/5202
USPC ..... 439/589, 935
See application file for complete search history.

(56) References Cited

U.S. PATENT DOCUMENTS

| | | | | |
|---|---|---|---|---|
| 3,998,515 | A * | 12/1976 | Panek | 439/198 |
| 4,176,901 | A * | 12/1979 | Ishimaru | 439/566 |
| 6,590,160 | B1 * | 7/2003 | Dopfl | 174/650 |
| 6,995,198 | B2 * | 2/2006 | Toshimitsu et al. | 523/204 |
| 7,829,792 | B2 * | 11/2010 | Pons et al. | 174/110 R |
| 8,461,456 | B2 * | 6/2013 | Bernauer | 174/152 G |
| 8,636,538 | B2 * | 1/2014 | Onodi et al. | 439/395 |
| 2007/0243762 | A1 | 10/2007 | Burke et al. | |
| 2010/0065305 | A1 | 3/2010 | Bernauer | |

FOREIGN PATENT DOCUMENTS

| | | |
|---|---|---|
| DE | 197 11 376 | 12/1997 |
| DE | 10 2008 045819 | 3/2010 |
| WO | 2008/111619 | 9/2008 |

OTHER PUBLICATIONS

French Search Report dated Jan. 31, 2012, corresponding to the Foreign Application No. 1157476.

* cited by examiner

*Primary Examiner* — Xuong Chung Trans
(74) *Attorney, Agent, or Firm* — Young & Thompson

(57) ABSTRACT

An electrical connector includes at least one insert (10), the insert including:

a front part (13) and a rear part (16) at least partially made of thermoplastic material, and a plurality of cavities (20) passing through from one side to the other of the front part and the rear part of the insert, each cavity being capable of receiving an electrical contact (30), a protection element (18) placed between the front part (13) and the rear part (16) and made of a flame-insensitive material capable, under the effect of high temperature, of maintaining a predefined distance between the electrical contacts.

5 Claims, 1 Drawing Sheet

ELECTRICAL CONNECTOR WITH FLAME-RESISTANT INSERTS

FIELD OF THE INVENTION

The invention pertains to an electrical connector equipped with an insert capable of at least partially resisting flames in order to prevent any shorting between the electrical contacts situated within the insert.

The invention can be applied in the field of connection systems especially in the field of aeronautic and automobile connection systems and in any other field using connectors in a motor environment.

PRIOR ART

In the field of connection systems, there are known ways of making electrical connectors, each equipped with a two-part insert enabling the electrical contacts to be mounted inside said insert. Such an insert generally has a front part and a rear part, both made out of a hard insulating material. The front part and the rear part are attached to one another, generally by gluing, so as to prevent any decoupling of the assembly and electrically insulate the electrical contacts. One or more longitudinal cavities are formed through the two front and rear parts of the insert, each receiving an electrical contact. In other words, each cavity passes through the front and rear parts of the insert, from one side to the other, and houses a male or female electrical contact, which is itself designed to be connected to a complementary contact, which is respectively female or male.

An example of a prior-art electrical connector is shown in FIG. 1. In this example, the electric connector has an insert 10 crossed by longitudinal cavities 20, only two of which can be seen in FIG. 1. This insert 10 has a front part 13 and a rear part 16. The front part 13 has a front insulator 11 as well as a front tight-sealing element 12. The rear part 16 has a rear insulator 15 as well as a rear tight-sealing element 14. The tight-sealing elements 12 and 14 provide for tight sealing inside the longitudinal cavities 20. The front and rear tight-sealing elements and the insulators are made in the form of plates attached to one another to constitute different layers of the insert 10. Each of these plates has an outline whose shape is adapted to the external shape of the connector.

Classically, the front insulator 11 and the rear insulator 15 are made out of identical materials of a thermoplastic type. Thermoplastic is a hard material with the property of softening repeatedly when heated above a certain temperature and becoming hard again when it goes below this temperature. This material therefore has the advantage of being easy to use and therefore easy to mould.

Thermoplastic also has the advantage of being reversible since its material can be re-melted and re-shaped several times in succession. It can thus be easily recycled. This makes it a material with environment-friendly properties.

Thermoplastic also has the advantage of being electrically insulating, whence its utility for manufacturing inserts for connectors. Its insulating character ensures the electrical protection of the electrical contacts housed in the cavities of the insert. In addition, at an ambient temperature below its melting temperature, thermoplastic sufficiently hard enough to provide mechanical protection to these electrical contacts, i.e. to ensure a minimum spacing between the contacts of the connector, thus preventing any electrical shorting between said contacts.

However, a thermoplastic insert subjected to a flame or to a high temperature close to its melting temperature will tend to soften or even to melt. The effect of this is that the distance between the electrical contacts housed in the insert will get reduced, especially when the connector has a large number of contacts. The electrical contacts will then no longer be electrically insulated from one another, and this can generate short-circuits within the connector and lead to damage to the insulation connected to this connector. It can thus be understood that it is difficult to use connectors with thermoplastic inserts in flame-hazard environments such as motor environments especially when the size of the connector is small and when the number of contacts is great, the consequence of which is to reduce the distance between two adjacent contacts.

Besides, there are inserts for which the front and rear insulators are made out of thermo-hardening material, also called thermoset. A thermoset brings into action a polymerization that is irreversible and thus leads to a solid and rigid finished product. This material, which is a perfect electrical insulator, provides electrical and mechanical protection to the electrical contacts. Furthermore, thermoset has the advantage of being a fire-retardant material, i.e. a material insensitive to flames. Indeed, since its polymerization is irreversible, an element made out of thermoset does not soften even when it is subjected to its initial melting temperature. Thus, a connector insert subjected to a standardized flame, i.e. a flame of standardized temperature and size, preserves its electrical properties for a period of at least five minutes. It additionally provides for electrical insulation (i.e. no shorting is created between the electrical contacts) for at least 18 minutes and for flame insulation (the flames do not pass through) for at least 20 minutes. In other words, an electrical connector equipped with an insert made of thermoset will keep all its electrical properties for at least five minutes and will withstand any internal shorting for at least 18 minutes. In certain environments, such as motor environments, it is important for the connector should be capable of being away from any flames in order to prevent any risk of shorting in the connector.

However, while thermoset has the advantage of being a fire-retardant material capable of preventing a standardized flame from crossing the connector, it nevertheless has the drawback wherein, because of its irreversibility, it cannot be transformed and therefore cannot be recycled. Now, the current trend is to protect the environment, especially by recycling the materials used in technical fields to the maximum. Since thermoset cannot be recycled, it goes against this trend for protecting the environment.

SUMMARY OF THE INVENTION

The invention is aimed precisely at overcoming the drawbacks of the techniques explained here above. To this end, the invention proposes an electrical connector equipped with an insert having environment-friendly properties and having a fire-retardant function that limits all risks of internal shorting. To this end, the connector of the invention has an insert made of thermoplastic provided with a protection element made out of a flame-insensitive material which can maintain a minimum distance between the electrical contacts, even in the event of high temperature, to prevent any shorting.

More specifically, the invention pertains to an electrical connector comprising at least one insert, said insert comprising:

- a front part and a rear part, at least partially made of thermoplastic material, and
- a plurality of cavities passing through from one side to the other of the front part and the rear part of the insert, each cavity being capable of receiving an electrical contact.

This connector is characterized by the fact that the insert has a protection element placed between the front part and the rear part and made of a flame-insensitive material capable, under the effect of high temperature, of maintaining a predefined distance between the electrical contacts.

This protection element has the advantage of not changing shape under the effect of high temperature, thus preventing any shorting between electrical contacts of the insert.

This connector may comprise one or more of the following characteristics:

- the protection element is made of ceramic, the ceramic having the advantage of being electrically insulating, hard and flame-insensitive.
- the protection element has a shape of a plate with an outline having dimensions substantially identical to the external dimensions of the front and rear parts of the insert.
- the protection element is pierced with a plurality of holes, the dimensions of which correspond to the external dimensions of the cavities of the insert.
- the protection element surrounds each cavity at the location of a zone containing the electrical contact.
- the protection element has a predefined thickness capable of maintaining a constant distance between the electrical contacts.
- the protection element is attached to a front insulator of the front part and to a rear insulator of the rear part of the insert to form one and the same element.
- the protection element can at least partially replace the front insulator or the rear insulator.

DETAILED DESCRIPTION OF EMBODIMENTS OF THE INVENTION

The description pertains to an electrical connector, the insert of which is capable of at least partially withstanding flames or high room temperature. In addition, this electrical connector has environment-friendly properties enabling it to be easily recycled.

Figure 1:
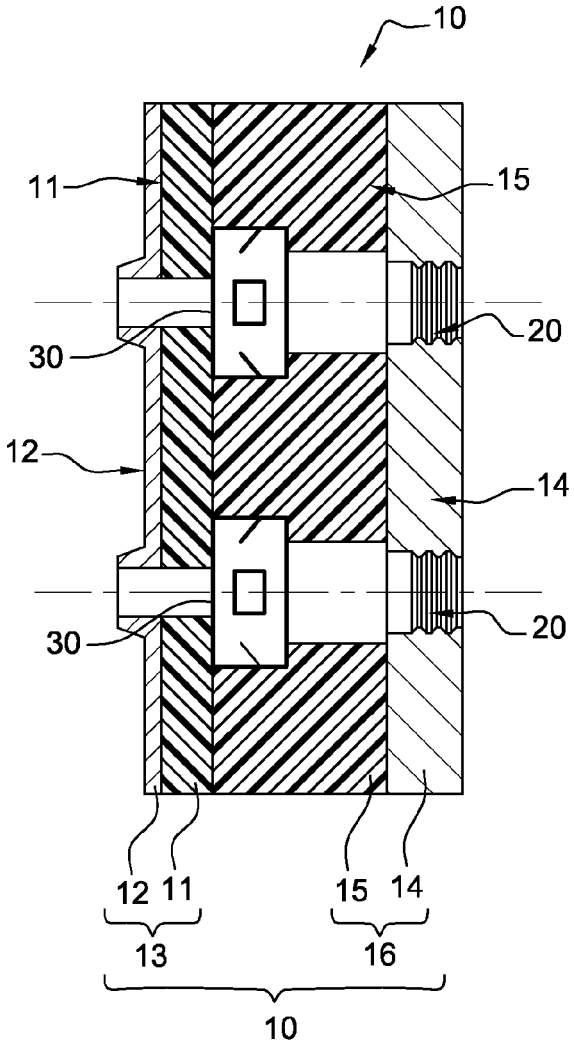
FIG. 1, already described, is a schematic representation of a cross-section view of an insert for a connector according to the prior art.
Figure 2:
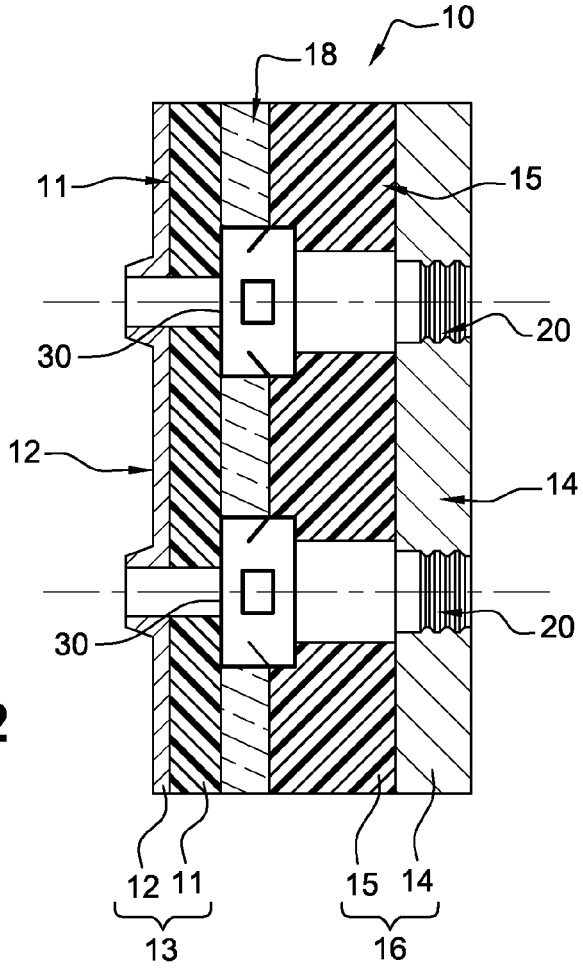
FIG. 2 is a schematic representation of a cross-section view of an insert for a connector according to the invention.

To this end, the connector of the invention comprises a two-part insert provided with a protection element made out of a flame-insensitive material. An example of a connector according to the invention is shown in FIG. 2. This connector has an insert 10 crossed by longitudinal cavities 20 each capable of housing an electrical contact 30.

This insert 10 has a front part 13 and a rear part 16. The front part 13 has a front insulator 11 attached to a front tight-sealing element 12. The front insulator 11 is made out of a thermoplastic material. The rear part 16 has a rear insulator 15, made out of a thermoplastic material, attached to a rear tight-sealing element 14.

According to the invention, the insert 10 also has an intermediate protection element 18 placed between the front part 13 and the rear 16. This protection element is made out of a material that is flame-insensitive and heat-insensitive so that it does not change shape or melt under the effect of high room temperature. The term "high temperature" is understood to mean the temperature of a flame that exceeds the melting temperature of the thermoplastic material.

This protection element 18 has a shape of a plate with dimensions suited to the external dimensions of the insert. In other words, it has an outline identical to the outline of the front insulator 11 and rear insulator 15, with dimensions in length and width identical to the dimensions of said insulators.

The protection element 18 is placed between the front insulator 11 and the rear insulator 15. It is attached to each of these insulators 11 and 15 so as to form one and the same rigid element.

In one embodiment of the invention, the protection element 18 can partially or totally constitute the front insulator 11 or rear insulator 15.

As explained here above, the insert 10 is crossed from one side to the other, throughout its length, by longitudinal cavities 20 each designed to receive an electrical contact 30. Each longitudinal cavity 20 has a shape adapted to the electrical contact that it receives. In particular, a cavity 20 has a housing designed to receive the electrical contact 30. At the zone of the cavity 20 surrounding the electrical contact, i.e. at the housing designed to receive the electrical contact 30, it is necessary for the insert to be heat-resistant in order to protect said electrical contact. To this end, in the invention, the protection element 18 has a thickness suited to the outline of this zone of the cavity 20 surrounding the electrical contact 30. In one preferred embodiment, the protection element 18 has a thickness substantially identical to the thickness of the front insulator 11.

According to the invention, the protection element 18 is made out of a material which has the particular feature of being not only flame-insensitive but also electrically insulating. This protection element can be a ceramic. Indeed, ceramics have the property of showing high mechanical resistance, low density, great hardness and high resistance to wear and tear. Ceramics furthermore have the advantage of being electrically insulating materials. As a consequence, an intermediate element made of ceramic is capable of providing for high insulation of the electrical contacts as well as mechanical protection for these electrical contacts.

Furthermore, since ceramics are irreversible materials, they are flame-resistant and resistant to high temperatures. As a consequence, a connector according to the invention placed in a high-temperature medium will not totally deteriorate: only the front insulator 11 and rear insulator 15 will change shape, while the protection element 18 will remain rigid. Since the protection element is placed around the electrical connection zones, the distance between the electrical contacts 30 will be kept, preventing any shorting between contacts, even if the insulators 11 and 15 soften or melt.

As can be understood from the above, the protection element 18 is provided with holes. More specifically, it has as many holes as there are longitudinal cavities going through the insert. The holes of this protection element made of ceramic have dimensions suited to the dimension of the outline of the longitudinal cavities of the insert. In this way, the protection element can surround the connection zone of the electrical contact 30, forming a protection chamber around each electrical contact.

Apart from its properties set forth here above, ceramic has environment-friendly characteristics. Indeed, it is a neutral and amorphous material, of no danger to man and the environment. A connector according to the invention therefore fits into the current trend towards the protection of the environment, using insulators made of thermoplastic that can be recycled and a minimum of materials that are not easy to recycle.

The invention claimed is:

1. An electrical connector, comprising:

an insert, said insert comprising:

a front part comprising a front insulator attached to a front tight-sealing element and a rear part comprising a rear insulator attached to a rear tight-sealing element, the front part and the rear part being at least partially made of a thermoplastic material, a plurality of cavities passing through from one side to the other side of the front part and the rear part of the insert, each cavity being configured to receive an electrical contact, and a protection element made of a flame-insensitive material, sandwiched between the front part and the rear part of the insert and having a plate shape pierced with a plurality of holes, dimensions of the holes corresponding to external dimensions of the cavities of the insert, the protection element surrounding each cavity at an area containing the electrical contacts, an outline and dimensions of the protection element being substantially identical to external dimensions of the front part and the rear part of the insert, the protection element being configured to maintain a fixed distance between the electrical contacts under the effect of a temperature exceeding the melting temperature of the thermoplastic material from which the front part and the rear part are made.

2. The electrical connector according to claim 1, wherein the protection element is made of ceramic.

3. The electrical connector according to claim 1, wherein a thickness of the protection element is substantially identical to a thickness of the front element.

4. The electrical connector according to claim 1, wherein the protection element is attached to the front insulator and the rear insulator to form one rigid element.

5. The electrical connector according to claim 1, wherein the protection element partially or completely constitutes the front insulator or the rear insulator.

* * * * *